US010152928B2

(12) United States Patent
Funatsu et al.

(10) Patent No.: US 10,152,928 B2
(45) Date of Patent: Dec. 11, 2018

(54) SIGNAL GENERATION APPARATUS, SIGNAL GENERATION PROGRAM, SIGNAL GENERATION METHOD, AND IMAGE DISPLAY APPARATUS

(71) Applicant: SONY CORPORATION, Tokyo (JP)

(72) Inventors: Yohei Funatsu, Tokyo (JP); Hidehisa Shimizu, Tokyo (JP)

(73) Assignee: SONY CORPORATION, Tokyo (JP)

( * ) Notice: Subject to any disclaimer, the term of this patent is extended or adjusted under 35 U.S.C. 154(b) by 111 days.

(21) Appl. No.: 14/913,351

(22) PCT Filed: May 23, 2014

(86) PCT No.: PCT/JP2014/063734

§ 371 (c)(1),
(2) Date: Feb. 19, 2016

(87) PCT Pub. No.: WO2015/025575

PCT Pub. Date: Feb. 26, 2015

(65) Prior Publication Data

US 2016/0203747 A1 Jul. 14, 2016

(30) Foreign Application Priority Data

Aug. 23, 2013 (JP) ..... 2013-173081

(51) Int. Cl.
*G09G 3/36* (2006.01)
*G09G 3/20* (2006.01)
(Continued)

(52) U.S. Cl.
CPC ..... *G09G 3/36* (2013.01); *G09G 3/2074* (2013.01); *G09G 3/30* (2013.01); *G09G 3/3208* (2013.01);
(Continued)

(58) Field of Classification Search
CPC ..... G09G 3/36; G09G 3/30; G09G 3/2074; G09G 3/3208; G09G 3/2003; G09G 3/3413
(Continued)

(56) References Cited

U.S. PATENT DOCUMENTS 5,619,280 A * 4/1997 Yamashita ..... H04N 9/67 348/645
5,790,261 A * 8/1998 Hayashi ..... H04N 1/6075 358/296
(Continued)

FOREIGN PATENT DOCUMENTS

JP 2009-500654 A 1/2009
JP 2009-093182 A 4/2009
(Continued)

OTHER PUBLICATIONS

Author: Akira Sakaigawa et al. 'Low Power Consumption Technology for Ultra-high Resolution Mobile Display by Using RGBW System', DES3-1, Published by ISSN-L 1883-2490/19/0709, 2012 ITE and SID, 709p-712p.
(Continued)

*Primary Examiner* — Fred Tzeng
(74) *Attorney, Agent, or Firm* — Chip Law Group

(57) ABSTRACT

An image display apparatus includes: an image display section in which a first sub-pixel for displaying a first primary color, a second sub-pixel for displaying a second primary color, a third sub-pixel for displaying a third primary color, and a fourth sub-pixel for displaying a fourth color are arranged in a 2D matrix; and a signal generation section to generate a signal for driving the image display section based on a first input image signal for displaying the first primary color, a second input image signal for displaying the second primary color, and a third input image signal for displaying the third primary color, that are supplied in correspondence with pixels of an image to be displayed, the signal generation section carries out processing of decreasing chroma and generates signals for driving the first sub-pixel, the second sub-pixel, the third sub-pixel, and the fourth sub-pixel based on those signals.

12 Claims, 8 Drawing Sheets

(51) Int. Cl.
*G09G 3/3208* (2016.01)
*G09G 3/30* (2006.01)
*G09G 5/06* (2006.01)

(52) U.S. Cl.
CPC ..... *G09G 3/2003* (2013.01); *G09G 3/3607* (2013.01); *G09G 5/06* (2013.01); *G09G 2300/0452* (2013.01); *G09G 2320/0238* (2013.01); *G09G 2320/0242* (2013.01); *G09G 2320/0646* (2013.01); *G09G 2320/0666* (2013.01); *G09G 2340/0457* (2013.01); *G09G 2340/06* (2013.01); *G09G 2360/16* (2013.01)

(58) Field of Classification Search
USPC ..... 345/694
See application file for complete search history.

(56) References Cited

U.S. PATENT DOCUMENTS 9,257,066 B2 * 2/2016 Roh ..... G09G 3/2003
2001/0016064 A1 * 8/2001 Tsuruoka ..... H04N 1/407 382/167
2008/0218779 A1 * 9/2008 Shirasawa ..... H04N 1/603 358/1.9
2009/0085847 A1 * 4/2009 Morisue ..... G09G 3/3406 345/88
2009/0136124 A1 * 5/2009 Matsuzaki ..... H04N 1/2307 382/162
2009/0290789 A1 * 11/2009 Burns ..... G09G 3/2003 382/162
2014/0225943 A1 * 8/2014 Shiobara ..... G09G 3/3413 345/694
2016/0005349 A1 * 1/2016 Atkins ..... H04N 5/20 345/591

FOREIGN PATENT DOCUMENTS

JP 2009-518660 A 5/2009
JP 2009-520241 A 5/2009
JP 2013-257477 A 12/2013
JP 2014-006328 A 1/2014

OTHER PUBLICATIONS

Author: Tae Nakahara et al. 'Image Quality Assessment of Ultra-high Resolution Mobile Display Utilizing New RGBW System', Published by ISSN, SID 2013 Digest, 955p-958p.

* cited by examiner

FIG.3A
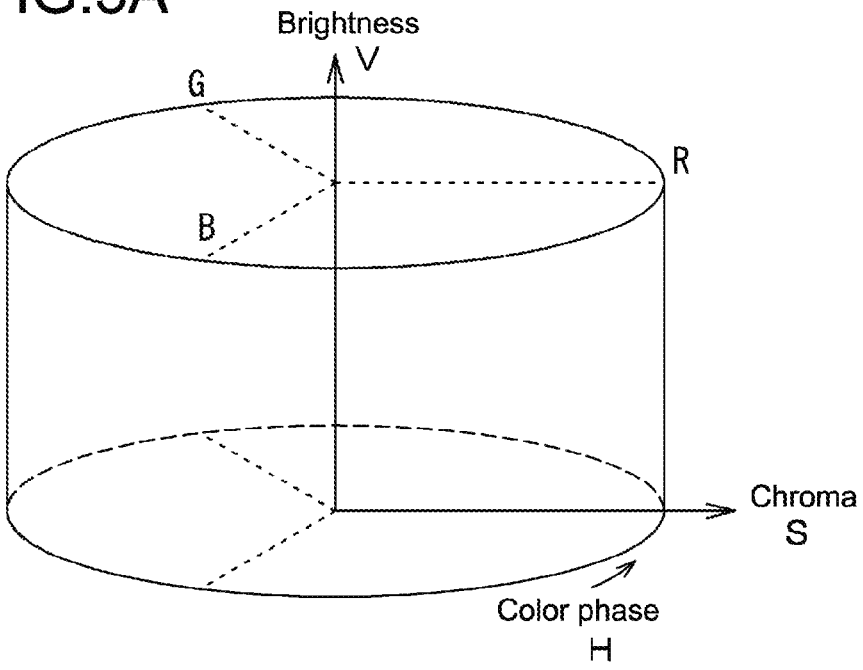
FIG.3B
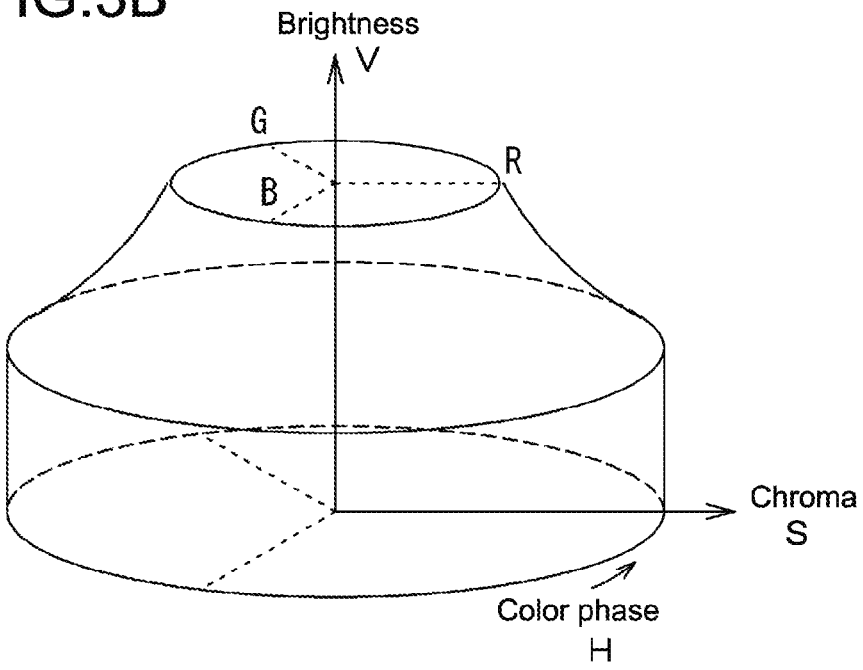
FIGS.3

SIGNAL GENERATION APPARATUS, SIGNAL GENERATION PROGRAM, SIGNAL GENERATION METHOD, AND IMAGE DISPLAY APPARATUS

TECHNICAL FIELD

The present disclosure relates to a signal generation apparatus, a signal generation program, a signal generation method, and an image display apparatus.

BACKGROUND ART

In recent years, for acquiring high luminance in color image display apparatuses, white sub-pixels for displaying a white color, for example, are added in addition to three types of sub-pixels, that is, red sub-pixels for displaying a red color, green sub-pixels for displaying a green color, and blue sub-pixels for displaying a blue color.

In the color image display apparatus including white sub-pixels, while bright display is possible in the case of an achromatic color or colors in the vicinity thereof, display becomes relatively dark in the case of displaying colors of high chroma. In other words, a displayable color range becomes narrower as brightness increases.

In contrast, for video signals acquired by a camera or the like, a maximum value is normally set irrespective of the chroma. Therefore, when an image is to be displayed on the color image display apparatus including white sub-pixels based on such video signals, the part that should be displayed brightly with high chroma is displayed with chroma and brightness that are relatively lowered.

For improving such a display state, for example, Japanese Patent Application Laid-open No. 2009-520241 (Patent Document 1) discloses a technique of uniformly decreasing chroma of video signals to compensate for lowering of brightness.

Patent Document 1: Japanese Patent Application Laid-open No. 2009-520241

SUMMARY OF INVENTION

Problem to be Solved by the Invention

In the technique disclosed in Patent Document 1, since chroma of an image is lowered also when an image having low brightness is displayed, the color range of an image to be displayed is narrowed. Moreover, a phenomenon that the compensation for the lowering of brightness is insufficient when displaying an image of high brightness occurs.

Therefore, the present disclosure aims at providing a signal generation apparatus, a signal generation program, a signal generation method, and an image display apparatus that are capable of displaying a high-chroma image when displaying a low-brightness image and sufficiently compensating for lowering of brightness when displaying a high-brightness image.

Means for Solving the Problem

To attain the object described above, according to the present disclosure, there is provided a signal generation apparatus that generates, based on a first input image signal for displaying a first primary color, a second input image signal for displaying a second primary color, and a third input image signal for displaying a third primary color, that are supplied in correspondence with pixels of an image to be displayed, a signal for driving an image display section in which a first sub-pixel for displaying the first primary color, a second sub-pixel for displaying the second primary color, a third sub-pixel for displaying the third primary color, and a fourth sub-pixel for displaying a fourth color are arranged in a 2D matrix, the signal generation apparatus carrying out, when the first input image signal, the second input image signal, and the third input image signal corresponding to the pixels are signals for performing display exceeding a reproduction range of colors displayable in the image display section, processing of decreasing chroma with respect to the first input image signal, the second input image signal, and the third input image signal, and generating signals for driving the first sub-pixel, the second sub-pixel, the third sub-pixel, and the fourth sub-pixel based on those signals.

Further, to attain the object described above, according to the present disclosure, there is provided a signal generation program that is executed in a signal generation apparatus that generates, based on a first input image signal for displaying a first primary color, a second input image signal for displaying a second primary color, and a third input image signal for displaying a third primary color, that are supplied in correspondence with pixels of an image to be displayed, a signal for driving an image display section in which a first sub-pixel for displaying the first primary color, a second sub-pixel for displaying the second primary color, a third sub-pixel for displaying the third primary color, and a fourth sub-pixel for displaying a fourth color are arranged in a 2D matrix, the signal generation program causing the signal generation apparatus to execute the step of carrying out, when the first input image signal, the second input image signal, and the third input image signal corresponding to the pixels are signals for performing display exceeding a reproduction range of colors displayable in the image display section, processing of decreasing chroma with respect to the first input image signal, the second input image signal, and the third input image signal, and generating signals for driving the first sub-pixel, the second sub-pixel, the third sub-pixel, and the fourth sub-pixel based on those signals.

Further, to attain the object described above, according to the present disclosure, there is provided a signal generation method for generating, based on a first input image signal for displaying a first primary color, a second input image signal for displaying a second primary color, and a third input image signal for displaying a third primary color, that are supplied in correspondence with pixels of an image to be displayed, a signal for driving an image display section in which a first sub-pixel for displaying the first primary color, a second sub-pixel for displaying the second primary color, a third sub-pixel for displaying the third primary color, and a fourth sub-pixel for displaying a fourth color are arranged in a 2D matrix, the signal generation method including carrying out, when the first input image signal, the second input image signal, and the third input image signal corresponding to the pixels are signals for performing display exceeding a reproduction range of colors displayable in the image display section, processing of decreasing chroma with respect to the first input image signal, the second input image signal, and the third input image signal, and generating signals for driving the first sub-pixel, the second sub-pixel, the third sub-pixel, and the fourth sub-pixel based on those signals.

Further, to attain the object described above, according to the present disclosure, there is provided an image display apparatus, including:

an image display section in which a first sub-pixel for displaying a first primary color, a second sub-pixel for displaying a second primary color, a third sub-pixel for displaying a third primary color, and a fourth sub-pixel for displaying a fourth color are arranged in a 2D matrix; and a signal generation section configured to generate a signal for driving the image display section based on a first input image signal for displaying the first primary color, a second input image signal for displaying the second primary color, and a third input image signal for displaying the third primary color, that are supplied in correspondence with pixels of an image to be displayed, in which the signal generation section carries out, when the first input image signal, the second input image signal, and the third input image signal corresponding to the pixels are signals for performing display exceeding a reproduction range of colors displayable in the image display section, processing of decreasing chroma with respect to the first input image signal, the second input image signal, and the third input image signal, and generates signals for driving the first sub-pixel, the second sub-pixel, the third sub-pixel, and the fourth sub-pixel based on those signals.

Effect of the Invention

According to the image display apparatus, the image display apparatus drive method, the signal generation apparatus, the signal generation program, and the signal generation method according to the present disclosure, an image is displayed while white sub-pixels are used effectively. As a result, a high-chroma image can be displayed when displaying a low-brightness image, and the lowering of brightness can sufficiently be compensated for when displaying a high-brightness image.

BRIEF DESCRIPTION OF DRAWINGS

FIG. 3A is a schematic diagram for describing an HSV color space of an input video signal. FIG. 3B is a schematic diagram for describing an HSV color space displayable by an image display section.

MODES FOR CARRYING OUT THE INVENTION

Figure 1:
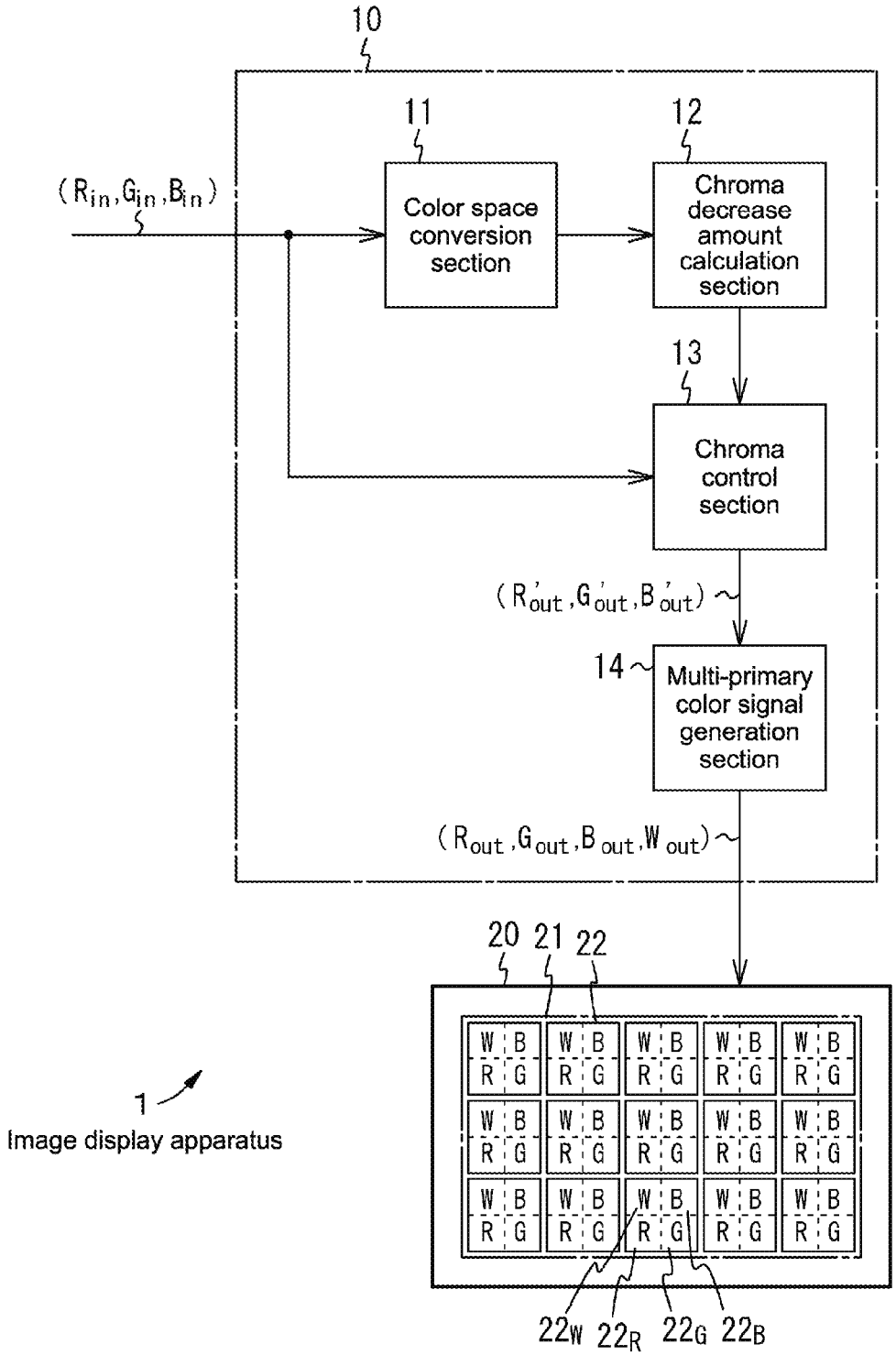
FIG. 1 is a schematic diagram of an image display apparatus according to a first embodiment.

Hereinafter, the present disclosure will be described based on an embodiment while referring to the drawings. The present disclosure is not limited to the embodiment, and various numerical values and materials of the embodiment are mere examples. In the following descriptions, the same elements or elements having the same function are denoted by the same symbols, and overlapping descriptions will be omitted. It should be noted that the descriptions will be given in the following order.

1. Overall descriptions on signal generation apparatus, signal generation program, signal generation method, and image display apparatus according to present disclosure 2. First embodiment, others (Overall Descriptions on Signal Generation Apparatus, Signal Generation Program, Signal Generation Method, and Image Display Apparatus According to Present Disclosure)

A signal generation apparatus according to the present disclosure, a signal generation apparatus in which a signal generation program according to the present disclosure is executed, and a signal generation apparatus used in an image display apparatus according to the present disclosure (hereinafter, may simply be referred to as signal generation apparatus of present disclosure) may include:

a color space conversion section configured to calculate a position in a color space based on values of the first input image signal, the second input image signal, and the third input image signal;

a chroma decrease amount calculation section configured to calculate a chroma decrease amount based on the calculated position in the color space;

a chroma control section configured to output the first input image signal, the second input image signal, and the third input image signal whose chroma have been changed based on the calculated chroma decrease amount; and a multi-primary color signal generation section configured to generate the signals for driving the first sub-pixel, the second sub-pixel, the third sub-pixel, and the fourth sub-pixel based on the first input image signal, the second input image signal, and the third input image signal whose chroma have been changed.

The system of the image display section used in the present disclosure (hereinafter, may simply be referred to as image display section of present disclosure) is not particularly limited. For example, the image display section may be suited for display of moving images or suited for display of still images. The image display section may adopt a self-luminous system like an electroluminescence display apparatus or a transmission-type system or a reflection-type system like a liquid crystal display apparatus, for example.

As values of pixels of the image display section, several values expressing image display resolutions can be exemplified in addition to VGA (640, 480), S-VGA (800, 600), XGA (1024, 768), APRC (1152, 900), S-XGA (1280, 1024), U-XGA (1600, 1200), HD-TV (1920, 1080), and Q-XGA (2048, 1536), the examples including (1920, 1035), (720, 480), and (1280, 960). However, the resolutions are not limited to those values.

In the signal generation apparatus according to the present disclosure that has the favorable structure described above, the first primary color, the second primary color, and the third primary color may be red, green, and blue, respectively, and the color space conversion section may calculate the position in the color space by converting the first input image signal, the second input image signal, and the third input image signal into Hue, Saturation, Value (HSV) color signals. In this case, the chroma decrease amount calculation section may calculate the chroma decrease amount based on a V value and an S value in the HSV color signals of the color space conversion section.

Alternatively, in the signal generation apparatus according to the present disclosure that has the favorable structure described above, the first primary color, the second primary color, and the third primary color may be red, green, and blue, respectively, and the color space conversion section may calculate the position in the color space by converting the first input image signal, the second input image signal, and the third input image signal into Hue, Saturation, Lightness (HSL) color signals. In this case, the chroma decrease amount calculation section may calculate the chroma decrease amount based on an L value and an S value in the HSL color signals of the color space conversion section.

In the signal generation apparatus according to the present disclosure that has the various favorable structures described above, the chroma control section may output the first input image signal, the second input image signal, and the third input image signal whose chroma have been changed by performing predetermined arithmetic operation processing on the values of the first input image signal, the second input image signal, and the third input image signal based on the calculated chroma decrease amount.

In the image display section according to the present disclosure, the fourth color may be white. It should be noted that the fourth color is not limited thereto and may be, for example, yellow, cyan, or magenta.

The signal generation section and signal generation apparatus used in the present disclosure may be constituted of, for example, an arithmetic operation circuit and a storage apparatus that can be structured using well-known circuit elements and the like. The signal generation section and the signal generation apparatus may be operated based on physical wire connections of hardware or may be operated based on programs.

The signal generation processing may involve processing input video signals in real time. It should be noted that according to circumstances, the signal generation processing may involve non-real-time processing. For example, it is also possible to successively process data of input video signals stored in storage means, store processed signal data in the storage means, and read out the processed signal data based on a user request.

For example, the chroma decrease amount calculation section may reference a lookup table (LUT) based on the L and S values in the HSL signals of the color space conversion section, or carry out arithmetic operation processing using a function that uses the L and S values as arguments.

Various conditions indicated in the specification are satisfied when the conditions are practically established, in addition to the case where the conditions are strictly established. For example, "red" only needs to be recognized as substantially red, and "green" only needs to be recognized as substantially green. The same holds true for "blue" and "white". Various variances caused during design and manufacturing are allowable.

First Embodiment

A first embodiment relates to the signal generation apparatus, the signal generation program, the signal generation method, and the image display apparatus according to the present disclosure.

FIG. 1 is a schematic diagram of the image display apparatus according to the first embodiment.

The image display apparatus 1 of the first embodiment includes an image display section 20 in which a first sub-pixel for displaying a first primary color, a second sub-pixel for displaying a second primary color, a third sub-pixel for displaying a third primary color, and a fourth sub-pixel for displaying a fourth color are arranged in a 2D matrix, and a signal generation section (signal generation apparatus) that generates a signal for driving the image display section 20.

The image display section 20 is constituted of a self-luminescence display panel including a current-drive-type light-emitting section, such as an organic electroluminescence panel.

In the first embodiment, the first primary color, the second primary color, and the third primary color are red, green, and blue, respectively, and the fourth color is white. The first sub-pixel of the image display section 20 for displaying the first primary color, the second sub-pixel thereof for displaying the second primary color, the third sub-pixel thereof for displaying the third primary color, and the fourth sub-pixel thereof for displaying the fourth color are denoted by codes $\mathbf{22}_R$, $\mathbf{22}_G$, $\mathbf{22}_B$, and $\mathbf{22}_W$, respectively. The pixel 22 of the image display section 20 is constituted of a set of the first sub-pixel $\mathbf{22}_R$, the second sub-pixel $\mathbf{22}_G$, the third sub-pixel $\mathbf{22}_B$, and the fourth sub-pixel $\mathbf{22}_W$. A display area in which the pixels 22 are arranged in a matrix is denoted by a code 21.

For convenience of descriptions, it is assumed that the white-color chromaticity (x, y) obtained by the first sub-pixel $\mathbf{22}_R$, the second sub-pixel $\mathbf{22}_G$, and the third sub-pixel $\mathbf{22}_B$ is the same as the white-color chromaticity (x, y) obtained by the fourth sub-pixel $\mathbf{22}_W$. It is also assumed that the white-color luminance $L_{rgb}$ obtained by the first sub-pixel $\mathbf{22}_R$, the second sub-pixel $\mathbf{22}_G$, and the third sub-pixel $\mathbf{22}_B$ and the white-color luminance $L_w$ of the fourth sub-pixel $\mathbf{22}_W$ are in a relationship expressed by $L_w=a*L_{rgb}$ where the code "a" is a predetermined coefficient.

Further, in the image display section 20, it is assumed that white display is performed using the fourth sub-pixel $\mathbf{22}_W$ alone, and a designed maximum light amount of the fourth sub-pixel $\mathbf{22}_W$ is twice the maximum light amount of white display at a time the first sub-pixel $\mathbf{22}_R$, the second sub-pixel $\mathbf{22}_G$, and the third sub-pixel $\mathbf{22}_B$ are all emitting light most brightly in terms of design. In other words, the relationship of $L_w=2*L_{rgb}$ is established.

Input image signals are supplied to the signal generation section 10 from an external apparatus in correspondence with pixels of an image to be displayed. For convenience of descriptions, the input image signals input from the external apparatus are each a 9-bit RGB-type linear signal, for example. Signals output from the signal generation section 10 are each an 8-bit linear signal, for example. It should be noted that in a case where the image display section 20 and the like have predetermined gamma characteristics, a correction only needs to be performed as appropriate considering the nonlinearity.

The signal generation section 10 carries out, when the first input image signal, the second input image signal, and the third input image signal corresponding to the pixels of the image to be displayed are signals for performing display exceeding a reproduction range of colors displayable in the image display section 20, processing of decreasing chroma with respect to the first input image signal, the second input image signal, and the third input image signal, and generates signals for driving the first sub-pixel $\mathbf{22}_R$, the second sub-pixel $\mathbf{22}_G$, the third sub-pixel $\mathbf{22}_B$, and the fourth sub-pixel $\mathbf{22}_W$ based on those signals. The signal generation section 10 operates based on the signal generation program stored in the storage means (not shown).

The first input image signal for red-color display, the second input image signal for green-color display, and the third input image signal for blue-color display are denoted by codes $R_{in}$, $G_{in}$, and $B_{in}$, respectively. The signals $R_{in}$, $G_{in}$, and $B_{in}$ take values between 0 to 511 according to luminance of an image to be displayed. Here, the value "0" indicates minimum luminance, and the value "511" indicates maximum luminance. Moreover, in the descriptions below, the first input image signal $R_{in}$, the second input image signal $G_{in}$, and the third input image signal $B_{in}$ may collectively be referred to as input image signals $R_{in}$, $G_{in}$, and $B_{in}$ in some cases.

The structure of the signal generation section 10 will be described. The signal generation section 10 includes:

a color space conversion section 11 configured to calculate a position in a color space based on values of the first input image signal $R_{in}$, the second input image signal $G_{in}$, and the third input image signal $B_{in}$;

a chroma decrease amount calculation section 12 configured to calculate a chroma decrease amount based on the calculated position in the color space;

a chroma control section 13 configured to output the first input image signal $R_{in}'$, the second input image signal $G_{in}'$, and the third input image signal $B_{in}'$ whose chroma have been changed based on the calculated chroma decrease amount; and a multi-primary color signal generation section 14 configured to generate the signals for driving the first sub-pixel $\mathbf{22}_R$, the second sub-pixel $\mathbf{22}_G$, the third sub-pixel $\mathbf{22}_B$, and the fourth sub-pixel $\mathbf{22}_W$ based on the first input image signal $R_{in}'$, the second input image signal $G_{in}'$, and the third input image signal $B_{in}'$ whose chroma have been changed.

A general outline of the operations of the signal generation section 10 will be described. The input image signals $R_{in}$, $G_{in}$, and $B_{in}$ of the RGB system are input to the color space conversion section 11 and the chroma control section 13. The color space conversion section 11 converts the RGB space of the input image signals $R_{in}$, $G_{in}$, and $B_{in}$ into an HSV space. The chroma decrease amount calculation section 12 calculates a chroma decrease gain according to S and V values obtained from the input image signals $R_{in}$, $G_{in}$, and $B_{in}$.

The chroma control section 13 carries out an arithmetic operation for lowering chroma of the input image signals $R_{in}$, $G_{in}$, and $B_{in}$ using the chroma decrease gain. The video signals having the chroma decreased as described above are input to the multi-primary color signal generation section 14. The multi-primary color signal generation section 14 carries out processing of converting RGB space signals into multi-primary color space signals.

It should be noted that a structure in which the color space conversion section 11 converts the RGB space of the input image signals $R_{in}$, $G_{in}$, and $B_{in}$ into an HSL space and the chroma decrease amount calculation section 12 calculates the chroma decrease gain according to S and L values of the input image signals $R_{in}$, $G_{in}$, and $B_{in}$ is also possible.

Hereinafter, the structure and operations of the signal generation section 10 will be described in detail.

Figure 2:
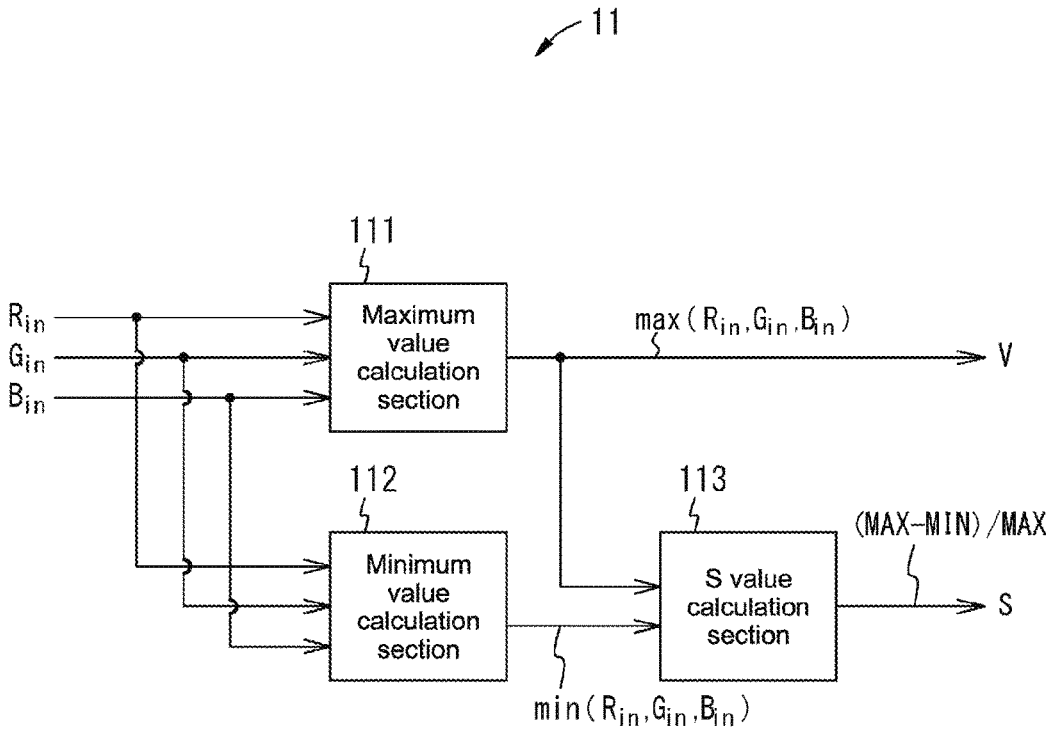
FIG. 2 is a schematic block diagram for describing a structure of a color space conversion section.

FIG. 2 is a schematic block diagram for describing the structure of the color space conversion section.

The color space conversion section 11 calculates a position in the color space by converting the first input image signal $R_{in}$, the second input image signal $G_{in}$, and the third input image signal $B_{in}$ into HSV color signals.

The color space conversion section 11 is constituted of a maximum value calculation section 111, a minimum value calculation section 112, and an S value calculation section 113. The input image signals $R_{in}$, $G_{in}$, and $B_{in}$ are input to the maximum value calculation section 111 and the minimum value calculation section 112 so that the maximum value calculation section 111 calculates maximum values $MAX=\max(R_{in}, G_{in}, B_{in})$ thereof and the minimum value calculation section 112 calculates minimum values $MIN=\min(R_{in}, G_{in}, B_{in})$ thereof. The function max( ) is a function that imparts a maximum value of an argument, and the function min( ) is a function that imparts a minimum value of the argument.

The maximum value calculation section 111 calculates the maximum value MAX as the V value. Further, the S value calculation section 113 calculates the S value as in the following expression (1) based on the maximum value MAX and the minimum value MIN.

$$S = \frac{MAX - MIN}{MAX} \tag{1}$$

The chroma decrease amount calculation section 12 calculates a chroma decrease amount based on the V and S values of the HSV color signals of the color space conversion section 11. Specifically, the chroma decrease amount calculation section 12 calculates the chroma decrease gain to be multiplied by the S value. The chroma decrease gain is calculated by referencing a predetermined lookup table.

Figure 4:
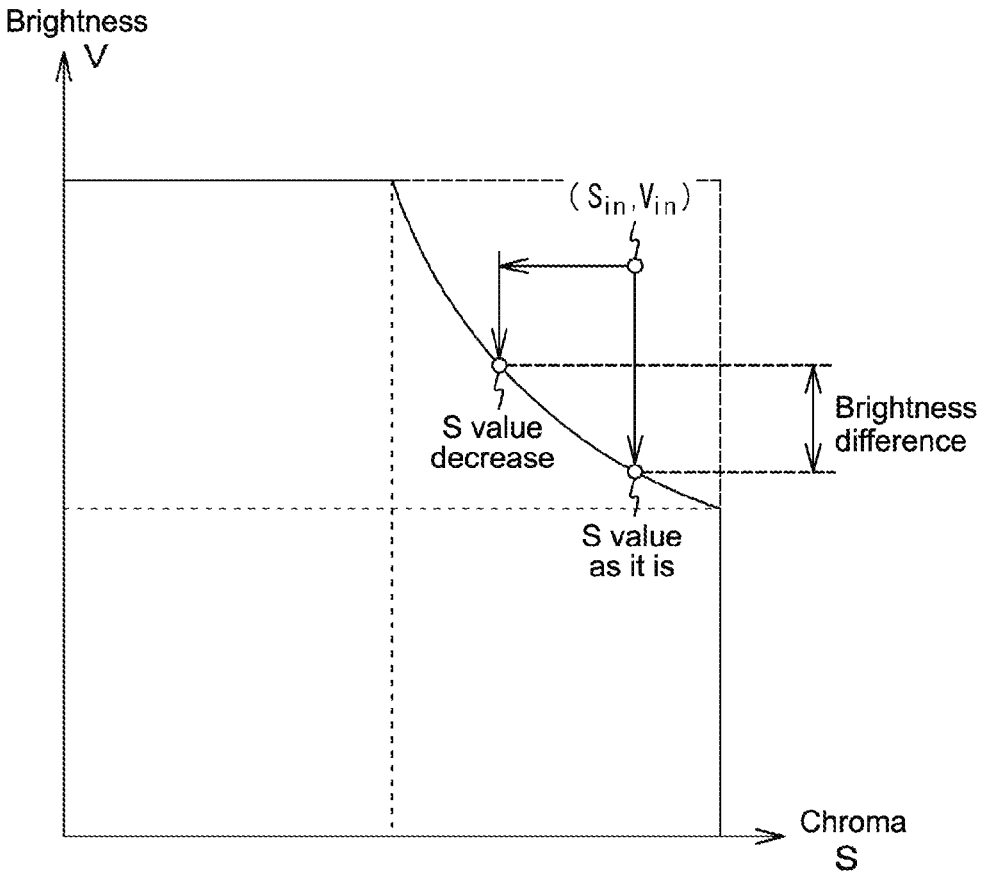
FIG. 4 is a schematic diagram for describing that brightness is raised by decreasing chroma.
Figure 5:
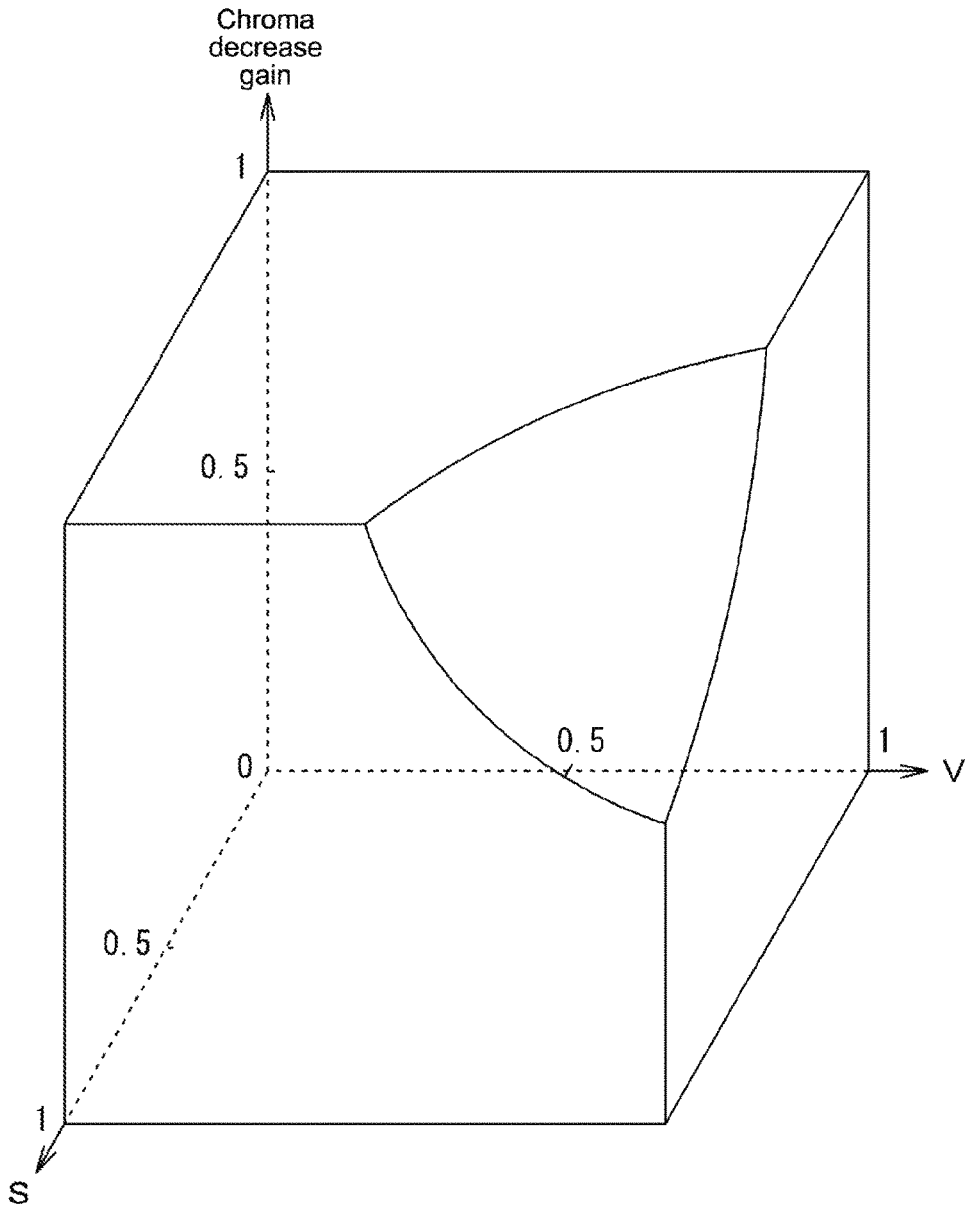
FIG. 5 is a schematic diagram for describing an operation of a LUT included in a chroma decrease amount calculation section.

Referring to FIGS. 3 to 5, the structure of the lookup table used for calculating the chroma decrease gain will be described.

FIG. 3A is a schematic diagram for describing an HSV color space of an input video signal. FIG. 3B is a schematic diagram for describing an HSV color space displayable by the image display section.

The input video signals $R_{in}$, $G_{in}$, and $B_{in}$ take values between 0 to 511 according to luminance of an image to be displayed. Therefore, the HSV color space of the input video signals is cylindrical as shown in FIG. 3A.

On the other hand, as described above, in the image display section 20, white display is performed using the fourth sub-pixel $\mathbf{22}_W$ alone, and a designed maximum light amount of the fourth sub-pixel $\mathbf{22}_W$ is twice the maximum light amount of white display at a time the first sub-pixel $\mathbf{22}_R$, the second sub-pixel $\mathbf{22}_G$, and the third sub-pixel $\mathbf{22}_B$ are all emitting light most brightly in terms of design. Therefore, bright display is possible by using the fourth sub-pixel $\mathbf{22}_W$ regarding a low-chroma image. However, an operation of the fourth sub-pixel $\mathbf{22}_W$ cannot avoid being suppressed as the chroma of an image increases. As a result, the HSV color space displayable by the image display section 20 has a cylindrical shape in the lower half and roughly a truncated cone shape in the upper half.

As is apparent from comparing FIGS. 3A and 3B, the space shown in FIG. 3B is narrower than that shown in FIG. 3A. When the position in the HSV space based on the input video signals $R_{in}$, $G_{in}$, and $B_{in}$ is not included in the space shown in FIG. 3B, that signal is a signal for performing display exceeding a reproduction range of colors displayable in the image display section 20.

The S and V values based on the input video signals $R_{in}$, $G_{in}$, and $B_{in}$ are represented by codes $S_{in}$ and $V_{in}$, respectively. When the input video signals $R_{in}$, $G_{in}$, and $B_{in}$ are signals for performing display exceeding a reproduction range of colors displayable in the image display section 20, if the position in the HSV space is caused to approach the space shown in FIG. 3B by reducing the code $S_{in}$ as shown in FIG. 4, lowering of brightness of an image can be compensated for while the chroma of the image is lowered.

As shown in FIG. 5, the lookup table referenced by the chroma decrease amount calculation section 12 is set such that a coefficient to lower the chroma as the S and V values based on the input video signals $R_{in}$, $G_{in}$, and $B_{in}$ approach 1 is calculated. When the S value is roughly 0.5 or less or the V value is roughly 0.5 or less, the S value does not need to be lowered, so the coefficient to be calculated is "1".

It should be noted that the lookup table referenced by the chroma decrease amount calculation section 12 can be determined by an experiment or the like using actual equipment or logically determined based on the shape of the color space or the like, for example.

The chroma control section 13 outputs the first input image signal $R_{in}'$, the second input image signal $G_{in}'$, and the third input image signal $B_{in}'$ whose chroma have been changed by carrying out predetermined arithmetic operation processing on the values of the first input image signal $R_{in}$, the second input image signal $G_{in}$, and the third input image signal $B_{in}$ based on the calculated chroma decrease amount.

Specifically, the calculated chroma decrease gain is input to the chroma control section 13 so that chroma control is performed on the input video signals $R_{in}$, $G_{in}$, and $B_{in}$. The chroma control is carried out as in the following expression (2).

$$\begin{bmatrix} R'_{in} \\ G'_{in} \\ B'_{in} \end{bmatrix} = G_S \cdot \begin{bmatrix} R_{in} \\ G_{in} \\ B_{in} \end{bmatrix} + (1 - G_S) \cdot \begin{bmatrix} V \\ V \\ V \end{bmatrix} \tag{2}$$

The code $G_s$ indicates a chroma decrease amount (chroma decrease gain) calculated for the HSV space. According to the expression (2) above, the chroma S can be made Gs times as large without changing the color phase H and brightness V before and after the arithmetic operation.

The chroma control is performed as described above to obtain the input video signals $R_{in}'$, $G_{in}'$, and $B_{in}'$ whose chroma have been changed.

Subsequently, the multi-primary color signal generation section 14 generates signals for driving the first sub-pixel $\mathbf{22}_R$, the second sub-pixel $\mathbf{22}_G$, the third sub-pixel $\mathbf{22}_B$, and the fourth sub-pixel $\mathbf{22}_W$ based on the input video signals $R_{in}'$, $G_{in}'$, and $B_{in}'$.

Figure 6:
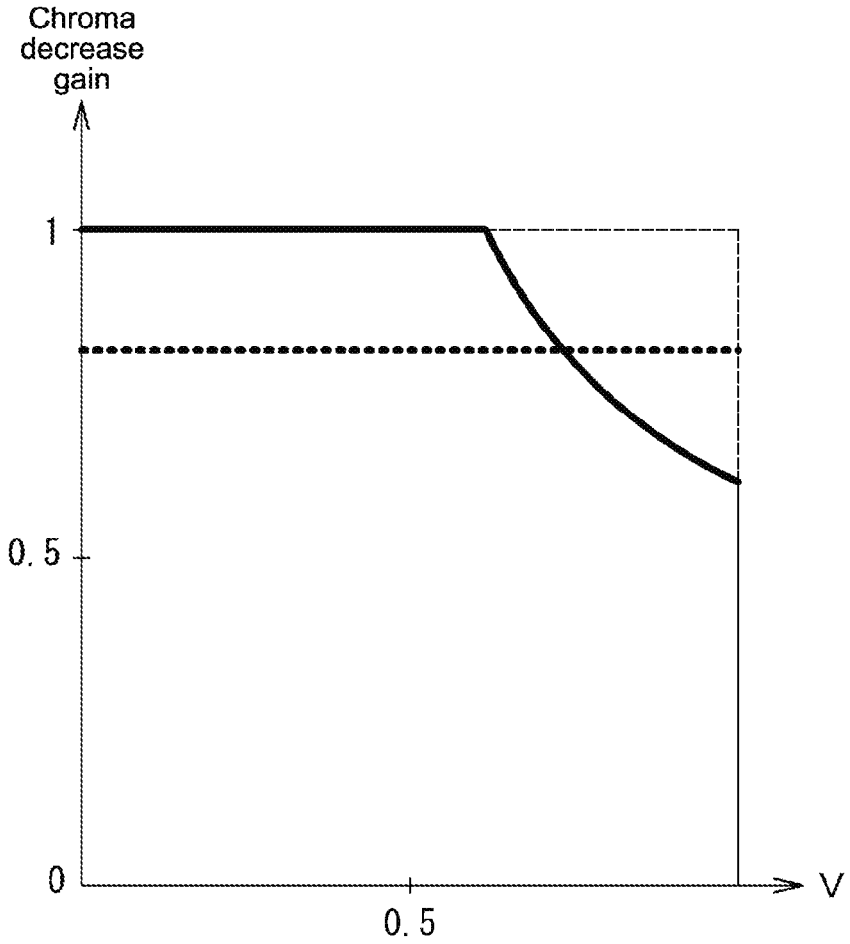
FIG. 6 is a schematic diagram for describing a difference between a case where a chroma decrease is performed fixedly and a case where the chroma decrease is performed dynamically.

For example, as indicated by the broken line of FIG. 6, when performing processing of uniformly decreasing the chroma without taking into account the brightness of the input video signals $R_{in}$, $G_{in}$, and $B_{in}$, the brightness of the image is lowered irrespective of the fact that brighter display is possible under ordinary circumstances.

In contrast, in the first embodiment, when the input video signals $R_{in}'$, $G_{in}$, and $B_{in}$ do not exceed the reproduction range of colors displayable in the image display section 20, a high-chroma image can be displayed. When the input video signals $R_{in}$, $G_{in}$, and $B_{in}$ exceed the reproduction range of colors displayable in the image display section 20, the lowering of brightness can sufficiently be compensated for.

Next, operations of the multi-primary color signal generation section 14 will be described.

Input to the multi-primary color signal generation section 14 are the input video signals $R_{in}'$, $G_{in}'$, and $B_{in}'$, and signals $R_{out}$, $G_{out}$, and $B_{out}$ for driving the first sub-pixel $\mathbf{22}_R$, the second sub-pixel $\mathbf{22}_G$, the third sub-pixel $\mathbf{22}_B$, and the fourth sub-pixel $\mathbf{22}_W$ are output therefrom. For convenience of descriptions, the signals $R_{out}$, $G_{out}$, and $B_{out}$ are assumed to be 8-bit signals.

The conversion expression from the signals $R_{in}'$, $G_{in}'$, and $B_{in}'$ to the signals $R_{out}$, $G_{out}$, and $B_{out}$ is expressed by the following expressions (3.1) to (3.4).

It should be noted that as a result of the calculations, when the signals $R_{out}$, $G_{out}$, and $B_{out}$ exceed 8 bits, the values are rounded to the maximum value of 8 bits (255), and when the signals $R_{out}$, $G_{out}$, and $B_{out}$ take negative values, the values are rounded to the minimum value of 8 bits (0).

$$W_{out} = b \cdot \mathrm{MIN}\left(\frac{R'_{in}}{a}, \frac{G'_{in}}{a}, \frac{B'_{in}}{a}\right) \tag{3.1}$$

$$R_{out} = R'_{in} - a \cdot W_{out} \tag{3.2}$$

$$G_{out} = G'_{in} - a \cdot W_{out} \tag{3.3}$$

$$B_{out} = B'_{in} - a \cdot W_{out} \tag{3.4}$$

The code "b" in the expressions above represents a coefficient expressing a conversion ratio with respect to the fourth sub-pixel $\mathbf{22}_W$ (white pixel), the coefficient having a range of 0 to 1. The conversion ratio with respect to the fourth sub-pixel $\mathbf{22}_W$ becomes minimum at b=0 and becomes maximum at b=1. As already described above, the code "a" represents a coefficient indicating a relationship such as $L_w = a * L_{rgb}$.

In the case of a=2, b=1, the above expressions (3.1) to (3.4) are expressed by the following expressions (4.1) to (4.4).

$$W_{out} = 1 \cdot \mathrm{MIN}\left(\frac{R'_{in}}{a}, \frac{G'_{in}}{a}, \frac{B'_{in}}{a}\right) \tag{4.1}$$

$$R_{out} = R'_{in} - 2 \cdot W_{out} \tag{4.2}$$

$$G_{out} = G'_{in} - 2 \cdot W_{out} \tag{4.3}$$

$$B_{out} = B'_{in} - 2 \cdot W_{out} \tag{4.4}$$

For convenience of descriptions on the operations, an example of the case where the input video signals $R_{in}'$, $G_{in}'$, and $B_{in}'$ exceed the reproduction range of colors displayable in the image display section 20 and an example of the case where the input video signals $R_{in}'$, $G_{in}'$, and $B_{in}'$ do not exceed the reproduction range will be described.

Figure 7:
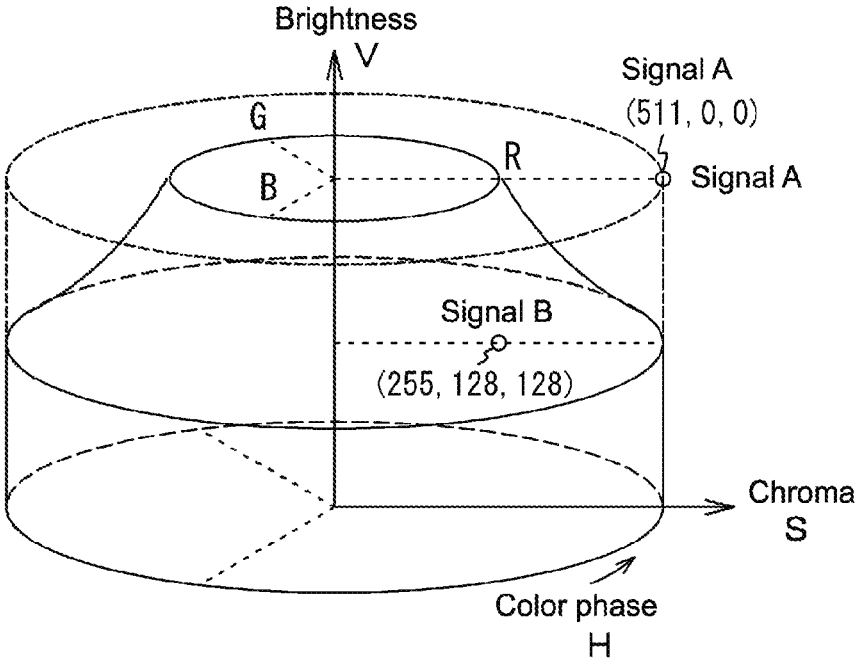
FIG. 7 is a schematic diagram for describing operations at a time of generating signals for driving a first sub-pixel, a second sub-pixel, a third sub-pixel, and a fourth sub-pixel in a case where a first input image signal, a second input image signal, and a third input image signal corresponding to pixels are signals for performing display exceeding a reproduction range of colors displayable in the image display section and a case where the signals are signals for performing display not exceeding the reproduction range.

The signal A shown in FIG. 7 indicates the example of the case where the input video signals $R_{in}'$, $G_{in}'$, and $B_{in}'$ exceed the reproduction range of colors displayable in the image display section 20. In addition, the signal B shown in FIG. 7 indicates the example of the case where the input video signals $R_{in}'$, $G_{in}'$, and $B_{in}'$ do not exceed the reproduction range of colors displayable in the image display section 20.

When the input video signals $R_{in}'$, $G_{in}'$, and $B_{in}'$ are the signal A (511, 0, 0), the values of $W_{out}$, $R_{out}$, $G_{out}$, and $B_{out}$ are expressed by the following expressions (5.1) to (5.4) from the above expressions (4.1) to (4.4).

$$W_{out} = 1 * \min(511/2, 0/2, 0/2) = 0 \quad (5.1)$$

$$R_{out} = 511 - 2 * 0 = 511 \rightarrow \text{rounded to } 255 \quad (5.2)$$

$$G_{out} = 0 - 2 * 0 = 0 \quad (5.3)$$

$$B_{out} = 0 - 2 * 0 = 0 \quad (5.4)$$

When the input video signals $R_{in}'$, $G_{in}'$, and $B_{in}'$ are the signal B (256, 128, 128), the values of $W_{out}$, $R_{out}$, $G_{out}$, and $B_{out}$ are expressed by the following expressions (6.1) to (6.4) from the above expressions (4.1) to (4.4).

$$W_{out} = 1 * \min(256/2, 128/2, 128/2) = 64 \quad (6.1)$$

$$R_{out} = 256 - 2 * 64 = 128 \quad (6.2)$$

$$G_{out} = 128 - 2 * 64 = 0 \quad (6.3)$$

$$B_{out} = 128 - 2 * 64 = 0 \quad (6.4)$$

Further, in the case of a=1, b=0.5, the above expressions (3.1) to (3.4) are expressed by the following expressions (7.1) to (7.4).

$$W_{out} = 0.5 \cdot \mathrm{MIN}\left(\frac{R_{in}'}{a}, \frac{G_{in}'}{a}, \frac{B_{in}'}{a}\right) \quad (7.1)$$

$$R_{out} = R_{in}' - 1 \cdot W_{out} \quad (7.2)$$

$$G_{out} = G_{in}' - 1 \cdot W_{out} \quad (7.3)$$

$$B_{out} = B_{in}' - 1 \cdot W_{out} \quad (7.4)$$

When the input video signals $R_{in}'$, $G_{in}'$, and $B_{in}'$ are the signal A (511, 0, 0), the values of $W_{out}$, $R_{out}$, $G_{out}$, and $B_{out}$ are expressed by the following expressions (8.1) to (8.4) from the above expressions (7.1) to (7.4).

$$W_{out} = 0.5 * \min(511/2, 0/2, 0/2) = 0 \quad (8.1)$$

$$R_{out} = 511 - 1 * 0 = 511 \rightarrow \text{rounded to } 255 \quad (8.2)$$

$$G_{out} = 0 - 1 * 0 = 0 \quad (8.3)$$

$$B_{out} = 0 - 1 * 0 = 0 \quad (8.4)$$

When the input video signals $R_{in}'$, $G_{in}'$, and $B_{in}'$ are the signal B (256, 128, 128), the values of $W_{out}$, $R_{out}$, $G_{out}$, and $B_{out}$ are expressed by the following expressions (9.1) to (9.4) from the above expressions (7.1) to (7.4).

$$W_{out} = 0.5 * \min(256/2, 128/2, 128/2) = 32 \quad (9.1)$$

$$R_{out} = 256 - 1 * 32 = 224 \quad (9.2)$$

$$G_{out} = 128 - 1 * 32 = 96 \quad (9.3)$$

$$B_{out} = 128 - 1 * 32 = 96 \quad (9.4)$$

Heretofore, the embodiment of the present invention has been described in detail, but the present invention is not limited to the embodiment above and can be variously modified based on the technical idea of the present invention.

For example, a structure in which the color space conversion section 11 converts the RGB space of the input video signals $R_{in}$, $G_{in}$, and $B_{in}$ into an HSL space and the chroma decrease amount calculation section 12 calculates the chroma decrease gain according to S and L values of the input video signals $R_{in}$, $G_{in}$, and $B_{in}$ is also possible.

Figure 8:
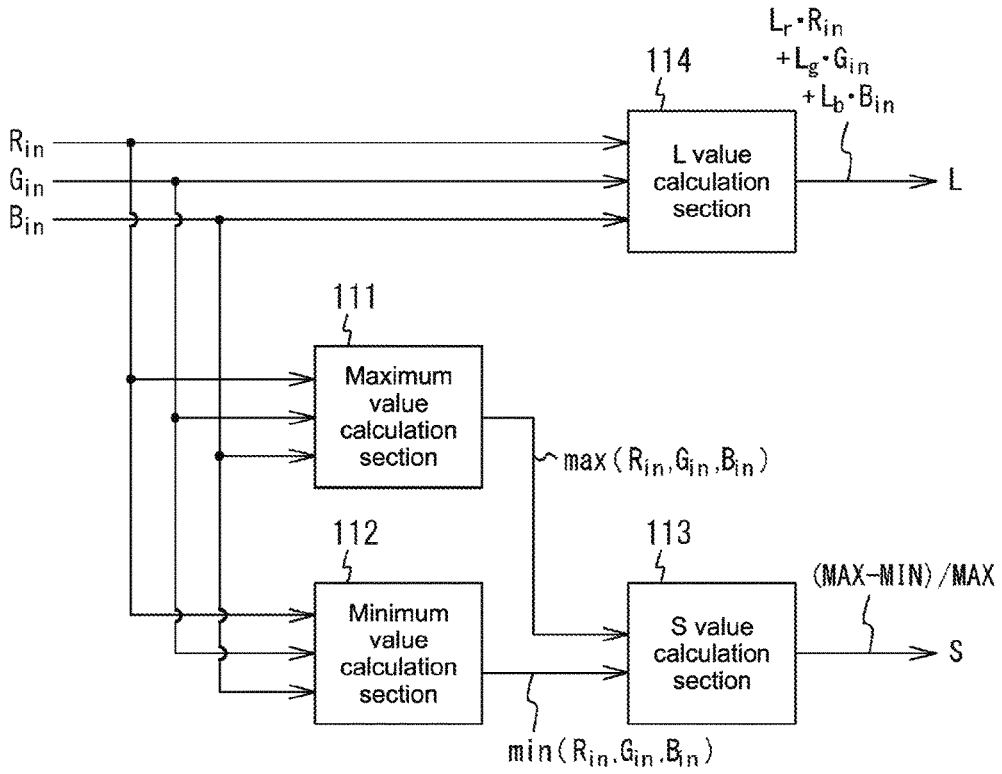
FIG. 8 is a schematic block diagram for describing another structural example of the color space conversion section.

FIG. 8 is a schematic block diagram for describing another structural example of the color space conversion section.

In this structural example, an L value calculation section 114 is added to the color space conversion section 11 described with reference to FIG. 2. The operations of the maximum value calculation section 111, the minimum value calculation section 112, and the S value calculation section 113 have been described with reference to FIG. 2, so descriptions thereof will be omitted.

The L value calculation section 114 calculates the L value based on the values of the input video signals $R_{in}$, $G_{in}$, and $B_{in}$ and luminance ratio coefficients $L_r$, $L_g$, and $L_b$ using the following expression (10).

$$L = L_r * R_{in} + L_g * G_{in} + L_b * B_{in} \quad (10)$$

note that $L_r + L_g + L_b = 1$

In addition, the chroma control is carried out as in the following expression (11).

$$\begin{bmatrix} R_{out} \\ G_{out} \\ B_{out} \end{bmatrix} = G_S \cdot \begin{bmatrix} R_{in} \\ G_{in} \\ B_{in} \end{bmatrix} + (1 - G_S) \cdot \begin{bmatrix} L \\ L \\ L \end{bmatrix} \quad (11)$$

According to the expression above, the chroma S can be converted as in the following expression (12) without changing the color phase H and luminance L before and after the arithmetic operation. The code $S_{out}$ is a chroma value after the processing, and the code $S_{in}$ is a chroma value before the processing.

$$S_{out} = \frac{G_S \cdot V}{G_S \cdot V + (1 - G_S) \cdot L} \cdot S_{in} \quad (12)$$

Further, in the descriptions on the embodiment, the H value (color phase value) is not taken into account in the calculation of the chroma decrease amount, but a structure in which the chroma decrease amount is calculated while taking the chroma decrease amount into account is also possible.

It should be noted that the present disclosure may also take the following structures.

[1] A signal generation apparatus that generates, based on a first input image signal for displaying a first primary color, a second input image signal for displaying a second primary color, and a third input image signal for displaying a third primary color, that are supplied in correspondence with pixels of an image to be displayed, a signal for driving an image display section in which a first sub-pixel for displaying the first primary color, a second sub-pixel for displaying the second primary color, a third sub-pixel for displaying the third primary color, and a fourth sub-pixel for displaying a fourth color are arranged in a 2D matrix, the signal generation apparatus carrying out, when the first input image signal, the second input image signal, and the third input image signal corresponding to the pixels are signals for performing display exceeding a reproduction range of colors displayable in the image display section, processing of decreasing chroma with respect to the first input image signal, the second input image signal, and the third input image signal, and generating signals for driving the first sub-pixel, the second sub-pixel, the third sub-pixel, and the fourth sub-pixel based on those signals.

[2] The signal generation apparatus according to [1] above, including:

a color space conversion section configured to calculate a position in a color space based on values of the first input image signal, the second input image signal, and the third input image signal;

a chroma decrease amount calculation section configured to calculate a chroma decrease amount based on the calculated position in the color space;

a chroma control section configured to output the first input image signal, the second input image signal, and the third input image signal whose chroma have been changed based on the calculated chroma decrease amount; and a multi-primary color signal generation section configured to generate the signals for driving the first sub-pixel, the second sub-pixel, the third sub-pixel, and the fourth sub-pixel based on the first input image signal, the second input image signal, and the third input image signal whose chroma have been changed.

[3] The signal generation apparatus according to [2] above, in which:

the first primary color, the second primary color, and the third primary color are red, green, and blue, respectively; and the color space conversion section calculates the position in the color space by converting the first input image signal, the second input image signal, and the third input image signal into HSV color signals.

[4] The signal generation apparatus according to [3] above, in which the chroma decrease amount calculation section calculates the chroma decrease amount based on a V value and an S value in the HSV color signals of the color space conversion section.

[5] The signal generation apparatus according to [2] above, in which:

the first primary color, the second primary color, and the third primary color are red, green, and blue, respectively; and the color space conversion section calculates the position in the color space by converting the first input image signal, the second input image signal, and the third input image signal into HSL color signals.

[6] The signal generation apparatus according to [5] above, in which the chroma decrease amount calculation section calculates the chroma decrease amount based on an L value and an S value in the HSL color signals of the color space conversion section.

[7] The signal generation apparatus according to any one of [2] to [6] above, in which the chroma control section outputs the first input image signal, the second input image signal, and the third input image signal whose chroma have been changed by performing predetermined arithmetic operation processing on the values of the first input image signal, the second input image signal, and the third input image signal based on the calculated chroma decrease amount.

[8] The signal generation apparatus according to any one of [1] to [7] above, in which the fourth color is white.

[9] A signal generation program that is executed in a signal generation apparatus that generates, based on a first input image signal for displaying a first primary color, a second input image signal for displaying a second primary color, and a third input image signal for displaying a third primary color, that are supplied in correspondence with pixels of an image to be displayed, a signal for driving an image display section in which a first sub-pixel for displaying the first primary color, a second sub-pixel for displaying the second primary color, a third sub-pixel for displaying the third primary color, and a fourth sub-pixel for displaying a fourth color are arranged in a 2D matrix, the signal generation program causing the signal generation apparatus to execute the step of carrying out, when the first input image signal, the second input image signal, and the third input image signal corresponding to the pixels are signals for performing display exceeding a reproduction range of colors displayable in the image display section, processing of decreasing chroma with respect to the first input image signal, the second input image signal, and the third input image signal, and generating signals for driving the first sub-pixel, the second sub-pixel, the third sub-pixel, and the fourth sub-pixel based on those signals.

[10] The signal generation program according to [9] above, in which the signal generation apparatus includes:

a color space conversion section configured to calculate a position in a color space based on values of the first input image signal, the second input image signal, and the third input image signal;

a chroma decrease amount calculation section configured to calculate a chroma decrease amount based on the calculated position in the color space;

a chroma control section configured to output the first input image signal, the second input image signal, and the third input image signal whose chroma have been changed based on the calculated chroma decrease amount; and a multi-primary color signal generation section configured to generate the signals for driving the first sub-pixel, the second sub-pixel, the third sub-pixel, and the fourth sub-pixel based on the first input image signal, the second input image signal, and the third input image signal whose chroma have been changed.

[11] The signal generation program according to [10] above, in which:

the first primary color, the second primary color, and the third primary color are red, green, and blue, respectively; and the color space conversion section calculates the position in the color space by converting the first input image signal, the second input image signal, and the third input image signal into HSV color signals.

[12] The signal generation program according to [11] above, in which the chroma decrease amount calculation section calculates the chroma decrease amount based on a V value and an S value in the HSV color signals of the color space conversion section.

[13] The signal generation program according to [10] above, in which:

the first primary color, the second primary color, and the third primary color are red, green, and blue, respectively; and the color space conversion section calculates the position in the color space by converting the first input image signal, the second input image signal, and the third input image signal into HSL color signals.

[14] The signal generation program according to [13] above, in which the chroma decrease amount calculation section calculates the chroma decrease amount based on an L value and an S value in the HSL color signals of the color space conversion section.

[15] The signal generation program according to any one of [10] to [14] above, in which the chroma control section outputs the first input image signal, the second input image signal, and the third input image signal whose chroma have been changed by performing predetermined arithmetic operation processing on the values of the first input image signal, the second input image signal, and the third input image signal based on the calculated chroma decrease amount.

[16] The signal generation program according to any one of [9] to [15] above, in which the fourth color is white.

[17] A signal generation method for generating, based on a first input image signal for displaying a first primary color, a second input image signal for displaying a second primary color, and a third input image signal for displaying a third primary color, that are supplied in correspondence with pixels of an image to be displayed, a signal for driving an image display section in which a first sub-pixel for displaying the first primary color, a second sub-pixel for displaying the second primary color, a third sub-pixel for displaying the third primary color, and a fourth sub-pixel for displaying a fourth color are arranged in a 2D matrix, the signal generation method including carrying out, when the first input image signal, the second input image signal, and the third input image signal corresponding to the pixels are signals for performing display exceeding a reproduction range of colors displayable in the image display section, processing of decreasing chroma with respect to the first input image signal, the second input image signal, and the third input image signal, and generating signals for driving the first sub-pixel, the second sub-pixel, the third sub-pixel, and the fourth sub-pixel based on those signals.

[18] The signal generation method according to [17] above, in which:

the first primary color, the second primary color, and the third primary color are red, green, and blue, respectively; and the position in the color space is calculated by converting the first input image signal, the second input image signal, and the third input image signal into HSV color signals.

[19] The signal generation method according to [18] above, in which the chroma decrease amount is calculated based on a V value and an S value in the HSV color signals of the color space conversion section.

[20] The signal generation method according to [17] above, in which:

the first primary color, the second primary color, and the third primary color are red, green, and blue, respectively; and the position in the color space is calculated by converting the first input image signal, the second input image signal, and the third input image signal into HSL color signals.

[21] The signal generation method according to [20] above, in which the chroma decrease amount calculation section calculates the chroma decrease amount based on an L value and an S value in the HSL color signals of the color space conversion section.

[22] The signal generation method according to any one of [17] to [21] above, in which the first input image signal, the second input image signal, and the third input image signal whose chroma have been changed by performing predetermined arithmetic operation processing on the values of the first input image signal, the second input image signal, and the third input image signal based on the calculated chroma decrease amount are output.

[23] The signal generation method according to any one of [17] to [22] above, in which the fourth color is white.

[24] An image display apparatus, including:

an image display section in which a first sub-pixel for displaying a first primary color, a second sub-pixel for displaying a second primary color, a third sub-pixel for displaying a third primary color, and a fourth sub-pixel for displaying a fourth color are arranged in a 2D matrix; and a signal generation section configured to generate a signal for driving the image display section based on a first input image signal for displaying the first primary color, a second input image signal for displaying the second primary color, and a third input image signal for displaying the third primary color, that are supplied in correspondence with pixels of an image to be displayed, in which the signal generation section carries out, when the first input image signal, the second input image signal, and the third input image signal corresponding to the pixels are signals for performing display exceeding a reproduction range of colors displayable in the image display section, processing of decreasing chroma with respect to the first input image signal, the second input image signal, and the third input image signal, and generates signals for driving the first sub-pixel, the second sub-pixel, the third sub-pixel, and the fourth sub-pixel based on those signals.

[25] The image display apparatus according to [24] above, further including:

a color space conversion section configured to calculate a position in a color space based on values of the first input image signal, the second input image signal, and the third input image signal;

a chroma decrease amount calculation section configured to calculate a chroma decrease amount based on the calculated position in the color space;

a chroma control section configured to output the first input image signal, the second input image signal, and the third input image signal whose chroma have been changed based on the calculated chroma decrease amount; and a multi-primary color signal generation section configured to generate the signals for driving the first sub-pixel, the second sub-pixel, the third sub-pixel, and the fourth sub-pixel based on the first input image signal, the second input image signal, and the third input image signal whose chroma have been changed.

[26] The image display apparatus according to [25] above, in which:

the first primary color, the second primary color, and the third primary color are red, green, and blue, respectively; and the color space conversion section calculates the position in the color space by converting the first input image signal, the second input image signal, and the third input image signal into HSV color signals.

[27] The image display apparatus according to [26] above, in which the chroma decrease amount calculation section calculates the chroma decrease amount based on a V value and an S value in the HSV color signals of the color space conversion section.

[28] The image display apparatus according to [25] above, in which:

the first primary color, the second primary color, and the third primary color are red, green, and blue, respectively; and the color space conversion section calculates the position in the color space by converting the first input image signal, the second input image signal, and the third input image signal into HSL color signals.

[29] The image display apparatus according to [28] above, in which the chroma decrease amount calculation section calculates the chroma decrease amount based on an L value and an S value in the HSL color signals of the color space conversion section.

[30] The image display apparatus according to any one of [25] to [29] above, in which the chroma control section outputs the first input image signal, the second input image signal, and the third input image signal whose chroma have been changed by performing predetermined arithmetic operation processing on the values of the first input image signal, the second input image signal, and the third input image signal based on the calculated chroma decrease amount.

[31] The image display apparatus according to any one of [25] to [30] above, in which the fourth color is white.

DESCRIPTION OF SYMBOLS

1 image display apparatus
10 signal generation section (signal generation apparatus)
20 image display section
21 display area
22 pixel
$22_R$ first sub-pixel
$22_G$ second sub-pixel
$22_B$ third sub-pixel
$22_W$ fourth sub-pixel
111 maximum value calculation section
112 minimum value calculation section
113 S value calculation section
114 L value calculation section
$R_{in}$, $R_{in}'$ first input image signal
$G_{in}$, $G_{in}'$ second input image signal
$B_{in}$, $B_{in}'$ third input image signal

The invention claimed is:

1. A signal generation apparatus, comprising:

circuitry configured to:

receive, as input image signals, a first input image signal, a second input image signal, and a third input image signal, wherein each of the input image signals corresponds to a first pixel of a plurality of pixels of an image;

calculate a position in a color space, based on a value of each of the input image signals;

calculate a chroma decrease amount, based on the calculated position in the color space;

output as output image signals, a fourth output image signal, a fifth output image signal, and a sixth output image signal, wherein a first chroma of each of the output image signals is different from a second chroma of each of the input image signals, by the calculated chroma decrease amount;

generate drive signals to drive the first pixel, based on the output image signals; and control an image display device to display at least the first pixel, based on the drive signals, wherein the first pixel comprises:

a first sub-pixel to display a first primary color;

a second sub-pixel to display a second primary color;

a third sub-pixel to display a third primary color; and a fourth sub-pixel to display a fourth color.

2. The signal generation apparatus according to claim 1, wherein:

the first primary color, the second primary color, and the third primary color are red, green, and blue, respectively; and the circuitry is further configured to calculate the position in the color space, based on conversion of the first input image signal, the second input image signal, and the third input image signal into Hue, Saturation, and value (HSV) color signals.

3. The signal generation apparatus according to claim 2, wherein the circuitry is further configured to calculate the chroma decrease amount, based on a V value and an S value in the HSV color signals.

4. The signal generation apparatus according to claim 1, wherein:

the first primary color, the second primary color, and the third primary color are red, green, and blue, respectively; and the circuitry is further configured to calculate the position in the color space, based on conversion of the first input image signal, the second input image signal, and the third input image signal into Hue, Saturation, and Lightness (HSL) color signals.

5. The signal generation apparatus according to claim 4, wherein the circuitry is further configured to calculate the chroma decrease amount based on an L value and an S value in the HSL color signals.

6. The signal generation apparatus according to claim 1, wherein the circuitry is further configured to output the output image signals, based on:

arithmetic operation processing of the first input image signal, the second input image signal, and the third input image signal, and the chroma decrease amount.

7. The signal generation apparatus according to claim 1, wherein the fourth color is white.

8. The signal generation apparatus according to claim 1, wherein the first sub-pixel, the second sub-pixel, the third sub-pixel, and the fourth sub-pixel are in a 2D matrix.

9. A non-transitory computer-readable medium having stored thereon, computer-executable instructions, which when executed by a computer cause the computer to execute operations, the operations comprising:

receiving, as input image signals, a first input image signal, a second input image signal, and a third input image signal, wherein each of the input image signals corresponds to a first pixel of a plurality of pixels of an image;

calculating a position in a color space, based on a value of each of the input image signals;

calculating a chroma decrease amount, based on the calculated position in the color space;

outputting as output image signals, a fourth output image signal, a fifth output image signal, and a sixth output image signal, wherein a first chroma of each of the output image signals is different from a second chroma of each of the input image signals, by the calculated chroma decrease amount;

generating drive signals to drive the first pixel, based on the output image signals; and controlling an image display device to display at least the first pixel, based on the drive signals, wherein the first pixel comprises:

a first sub-pixel to display a first primary color;

a second sub-pixel to display a second primary color;

a third sub-pixel to display a third primary color; and a fourth sub-pixel to display a fourth color.

10. A signal generation method, comprising:

in a signal generation apparatus:

receiving, as input image signals, a first input image signal, a second input image signal, and a third input image signal, wherein each of the input image signals corresponds to a first pixel of a plurality of pixels of an image;

calculating a position in a color space, based on a value of each of the input image signals;

calculating a chroma decrease amount, based on the calculated position in the color space;

outputting as output image signals, a fourth output image signal, a fifth output image signal, and a sixth output image signal, wherein a first chroma of each of the output image signals is different from a second chroma of each of the input image signals, by the calculated chroma decrease amount;

generating drive signals to drive the first pixel, based on the output image signals; and controlling an image display device to display at least the first pixel, based on the drive signals, wherein the first pixel comprises:

a first sub-pixel to display a first primary color;

a second sub-pixel to display a second primary color;

a third sub-pixel to display a third primary color; and a fourth sub-pixel to display a fourth color.

11. An image display apparatus, comprising:

an image display device comprising:

a first plurality of pixels in a 2D matrix; and circuitry configured to:

receive, as input image signals, a first input image signal, a second input image signal, and a third input image signal, wherein each of the input image signals corresponds to a first pixel of a second plurality of pixels of an image;

calculate a position in a color space, based on a value of each of the input image signals;

calculate a chroma decrease amount, based on the calculated position in the color space;

output as output image signals, a fourth output image signal, a fifth output image signal, and a sixth output image signal, wherein a first chroma of each of the output image signals is different from a second chroma of each of the input image signals, by the calculated chroma decrease amount;

generate drive signals to drive the first pixel, based on the output image signals; and control the image display device to display at least the first pixel, based on the drive signals, wherein the first pixel comprises:

a first sub-pixel to display a first primary color;

a second sub-pixel to display a second primary color;

a third sub-pixel to display a third primary color; and a fourth sub-pixel to display a fourth color.

12. A signal generation apparatus, comprising:

circuitry configured to:

receive as input image signals, a first input image signal, a second input image signal, and a third input image signal, wherein each of the input image signals corresponds to a first pixel of a plurality of pixels of an image, and wherein each of the input image signals comprises bit information;

convert the input image signals into one of Hue, Saturation, and value (HSV) color signals or Hue, Saturation, and Lightness (HSL) color signals;

calculate a position in a color space based on the conversion;

calculate a chroma decrease amount, based on:

the calculated position in the color space; and the bit information of at least one of the input image signals, that exceeds a reproduction range of colors of an image display device;

output, as output image signals, a fourth output image signal, a fifth output image signal, and a sixth output image signal, based on the chroma decrease amount, wherein a first chroma of each of the output image signals is different from a second chroma of each of the input image signals, by the chroma decrease amount;

generate drive signals to drive the first pixel, based on the output image signals; and control the image display device to display at least the first pixel, wherein the first pixel comprises:

a first sub-pixel to display a first primary color;

a second sub-pixel to display a second primary color;

a third sub-pixel to display a third primary color; and a fourth sub-pixel to display a fourth color.

* * * * *